US005124514A

United States Patent [19]

Chen

[11] Patent Number: 5,124,514

[45] Date of Patent: Jun. 23, 1992

[54] STRUCTURE OF MECHANICAL KEY SWITCH

[76] Inventor: Win-Join Chen, 3F, No. 381, Sec. 2 Fu Hsing S. Rd., Taipei, Taiwan

[21] Appl. No.: 726,823

[22] Filed: Jul. 8, 1991

[51] Int. Cl.[5] ..... H01H 3/42

[52] U.S. Cl. ..... 200/533; 200/275; 200/573

[58] Field of Search ..... 200/239, 303, 520, 521, 200/533, 535, 545, 542, 275, 551, 573

[56] References Cited

U.S. PATENT DOCUMENTS

| | | | |
|---|---|---|---|
| 3,770,923 | 11/1973 | Habecker | 200/535 |
| 4,153,829 | 5/1979 | Murata | 200/533 |
| 4,514,608 | 4/1985 | Murata | 200/533 X |
| 4,920,245 | 4/1990 | Takano et al. | 200/533 |
| 4,935,591 | 6/1990 | Kaneko | 200/520 X |
| 5,004,880 | 4/1991 | Koutaka | 200/531 |

FOREIGN PATENT DOCUMENTS 3330624 3/1985 Fed. Rep. of Germany ..... 200/533

*Primary Examiner*—Henry J. Recla
*Assistant Examiner*—Glenn T. Barrett
*Attorney, Agent, or Firm*—Fleit, Jacobson, Cohn, Price, Holman & Stern

[57] ABSTRACT

A key switch comprising a bottom shell connected with an upper shell for holding a spring plate, a switching mechanism which is comprised of two conducting plates respectively connected to the two opposite terminals of a circuit, and a spring supported key cap, wherein said upper shell has two retaining grooves separated by a projecting strip for holding said two conducting plates respectively in place. The first conducting plate comprises a trigger frame obliquely disposed toward the spring plate and a contact end extending backward from said trigger frame. Pressing on the key cap causes the spring plate to move the trigger frame to carry its contact end to electrically contact the second conducting plate forming into a closed circuit.

2 Claims, 3 Drawing Sheets

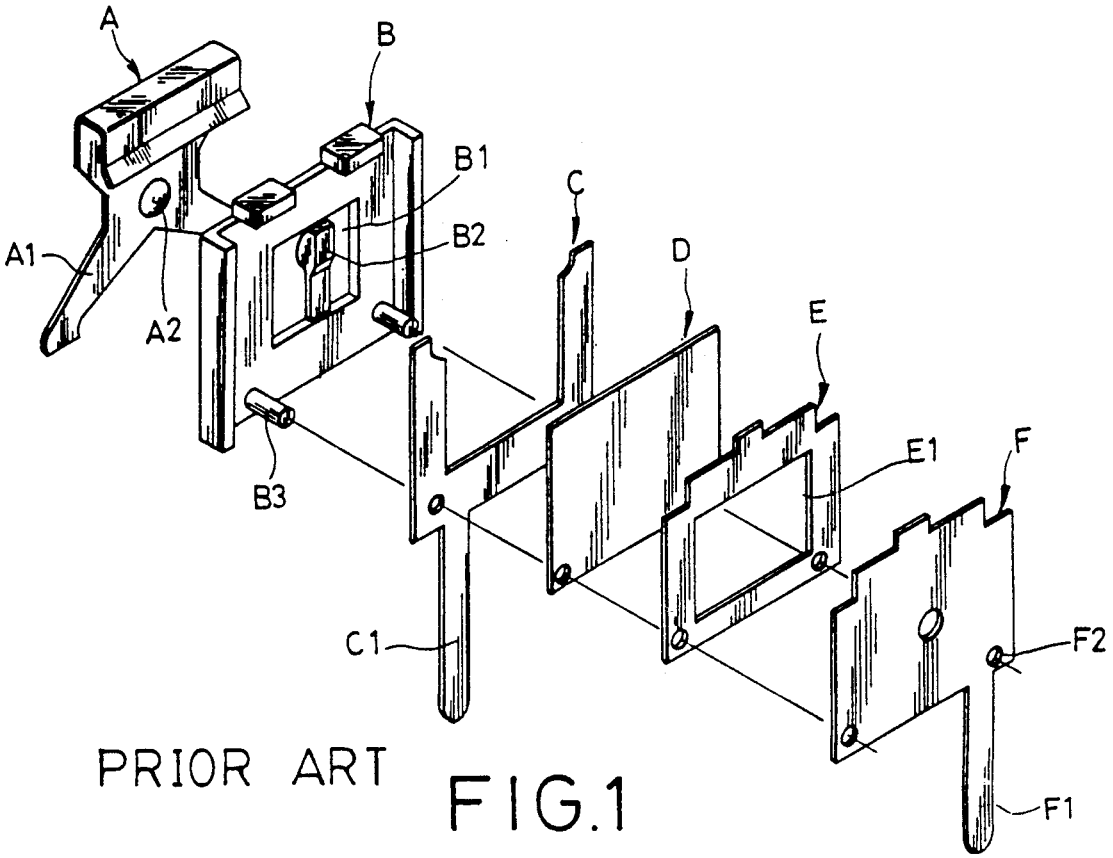
PRIOR ART FIG.1
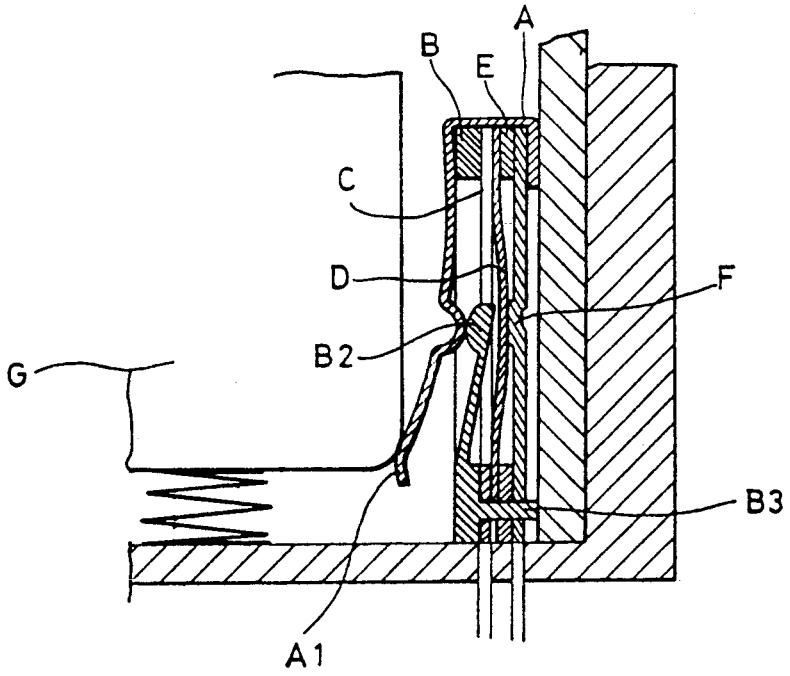
PRIOR ART FIG.2

STRUCTURE OF MECHANICAL KEY SWITCH

BACKGROUND OF THE INVENTION

The present invention relates to key switches and relates more particularly to a mechanical key switch which is consisted of less number of parts, easy to assemble and inexpensive to manufacture.

FIG. 1 illustrates a mechanical key switch according to the prior art, which comprises a casing having a key cap for controlling a switching mechanism to operate. The switching mechanism is comprised of six parts, namely, a spring plate A, a plastic frame plate B, a first conducting plate C, a thin copper plate D, an insulator plate E, and a second conducting plate F. The plastic frame plate B has two opposite pins B3 disposed at a lower end for fastening the first conducting plate C, the thin copper plate D, the insulator plate E and the second conducting plate F together. Referring to FIG. 2, pressing down the key cap G causes the two spring arms Al of the spring plate A to carry a raised portion A 2 thereon to squeeze the trigger rod B2 in the center hole B1 of the plastic frame plate B to press on the thin copper plate D permitting the think copper plate D to project through the center hole E1 of the insulator plate E and then to firmly contact the second conducting plate F so as to form into a closed circuit. Because numerous parts are required to assemble into a key switch, assembly process is complicated, material as well as labor cost can not be reduced.

SUMMARY OF THE INVENTION

The present invention has been accomplished to eliminate the aforesaid problems. It is therefore the main object of the present invention to provide a mechanical key switch which is simple in structure and easy to assemble and therefore, the manufacturing cost of which can be greatly reduced.

According to the present invention, there is provided a key switch which is comprised of a bottom shell connected with an upper shell for holding a spring plate, a switching mechanism which is comprised of two conducting plates respectively connected to the two opposite terminals of a circuit, and a spring supported key cap. The upper shell has two retaining grooves separated by a projecting strip for holding the two conducting plates respectively in place. The first conducting plate comprises a trigger frame obliquely disposed toward the spring plate and a contact end extending backward from said trigger frame. Pressing on the key cap causes the spring plate to move the trigger frame to carry its contact end to electrically contact the second conducting plate forming into a closed circuit.

BRIEF DESCRIPTION OF THE DRAWINGS

FIG. 1 is an exploded perspective view of a mechanical key switch according to the prior art;

FIG. 2 is a sectional assembly of the mechanical key switch according to the prior art;

DETAILED DESCRIPTION OF THE PREFERRED EMBODIMENT

Figure 3:
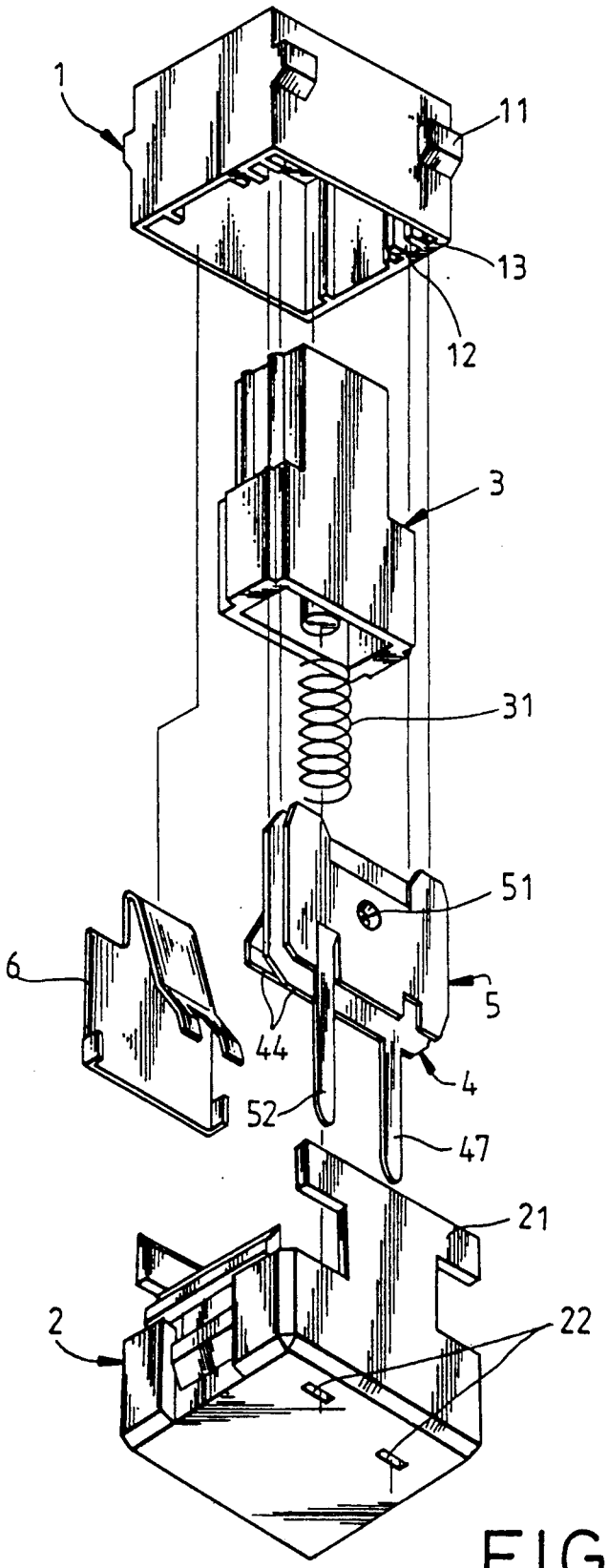
FIG. 3 is an exploded perspective view of the preferred embodiment of the present invention.

Referring to FIG. 3, a key switch in accordance with the present invention generally comprises an upper shell 1 connected with a bottom shell 2 for holding a key cap 3 a spring 31, a plate spring 6, and a switching mechanism which is consisted of two conducting plates 4 and 5. Pressing the key cap 3 which protrudes beyond the top edge of the upper shell 1 causes the two legs 47 and 52 of the two conducting plates 4 and 5, which protrude beyond the bottom edge of the bottom shell 2, to electrically connected into a closed circuit.

The upper shell 1 is made from plastic material, having two retaining grooves, namely, a front retaining groove 12 and a rear retaining groove 13 at the inside which are separated by a projecting strip which is integrally formed in the upper shell 1 during its production through the process of injection molding. The first conducting plate 4 is fastened to the front retaining groove 12 and the second conducting plate 5 is fastened in the rear retaining groove 13. Sliding of the key cap 3 vertically in the upper and bottom shells 1 and 2 causes the first and second conducting plates 4 and 5 to be electrically connected or disconnected.

Figure 4:
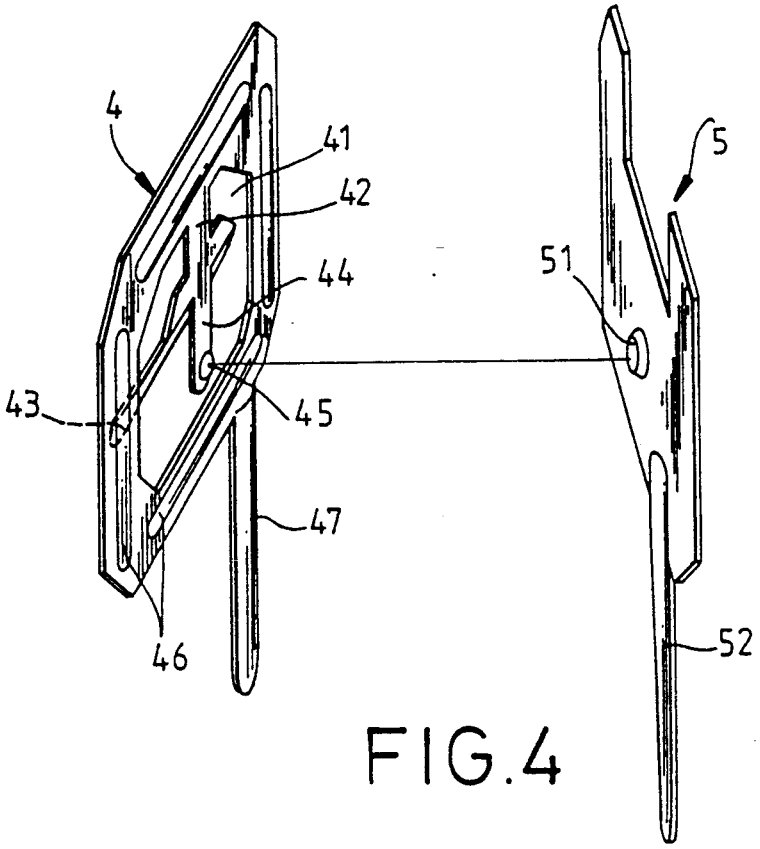
FIG. 4 illustrates the structure of the conducting plate.

Referring to FIG. 4, the first conducting plate 4 has an elongated leg 47 inserted through a pin hole 22 on the bottom edge of the bottom shell 2 for connecting a conductor through the process of tin soldering. The body of the first conducting plate 4 is made from a thin metal plate having an opening 41 at the center, a unitary suspension plate 42 extending from the top edge thereof into said opening 41 and terminating into a rectangular trigger frame 43 which has an extension 44 extending backwards therefrom, which extension 44 has a raised contact 45 at the back. The body of the first conducting plate 4 further has a plurality of unitary ribs 46 formed around the periphery thereof through the process of punching, which unitary ribs 46 strengthens the structural strength of the first conducting plate 4 and is simultaneously provided for positioning in the front retaining groove 12. The rectangular trigger frame 43 is obliquely disposed at the front through a suitable angle so that it can be pressed by the key cap 3 to move the extension 44 backwards when the key cap 3 is pressed down.

Figure 5:
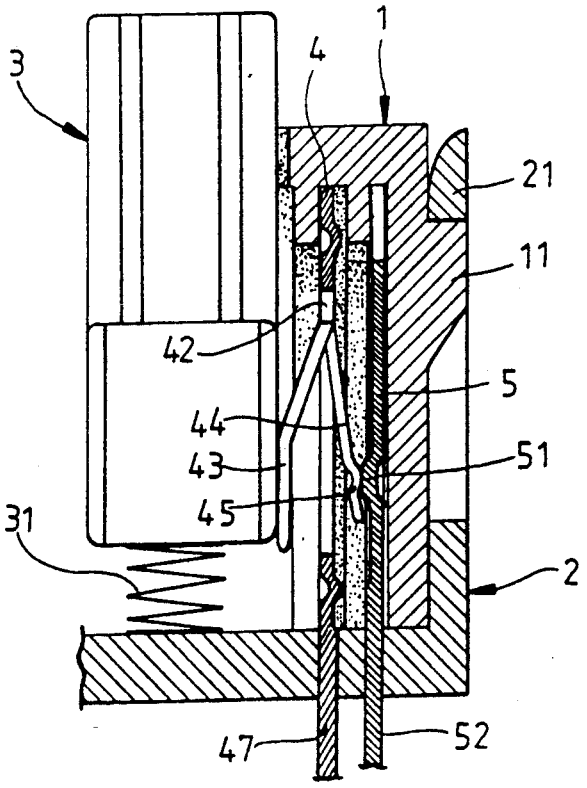
FIG. 5 is a sectional assembly view of the preferred embodiment of the present invention.

Referring to FIG. 5, after the upper shell 1, the bottom shell 2, the key cap 3, the first conducting plate 4, the second conducting plate 5 and the spring plate 6 are connected into a key switch, the first and second conducting plates 4 and 5 are isolated from each other. Once the key cap 3 is pressed downward to squeeze the rectangular trigger frame 43, the extension 44 is simultaneously moved backwards causing the raised contact 45 on the extension 44 to contact the raised contact 51 on the second conducting plate 5 so as to form into a closed circuit. Once pressure is released from the key cap 3, the spring 31 automatically forces the key cap 3 to move back t o original position permitting the raised contact 45 on the extension 44 to disconnect from the raised contact 51 on the second conducting plate 5.

As indicated, the structure of the key switch of the present invention is comprised of less number of parts which are easy to assemble and repair and therefore, the manufacturing cost can be greatly reduced.

What is claimed is:

1. A key switch comprising an upper shell connected with a bottom shell forming a housing having a key cap slidably disposed a spring coil in said housing biasing said key cap, a spring plate in said housing and a switching mechanism in said housing whereby said switching mechanism is electrically connected into a closed circuit when said key cap is depressed or electrically disconnected to form an open circuit when said key cap is moved by said spring coil to an original position, and characterized in that:

said upper shell is made from a plastic material, having two retaining grooves extending longitudinally on an inner wall surface, said grooves being positioned in said upper shell and located on one side of said key cap and a unitary projection strip positioned in said upper shell to separate said two retaining grooves said spring plate being positioned in said upper shell on a side opposite to said one side; said witching mechanism comprises a first conducting plate and a second conducting plate respectively fastened in said two retaining grooves, said first conducting plate being made from a thin metal plate having a periphery and a central opening a unitary suspension plate extending from the a top edge of said opening into said opening and terminating in a rectangular trigger frame obliquely disposed toward said spring plate, said rectangular trigger plate contacting said key cap when said key cap is depressed, said rectangular trigger frame having an extension extending away from said spring plate said extension having a raised contact on a surface facing said second contact plate and said first contacting plate having a leg extending from the periphery out of said bottom shell said leg being adapted to be connected to a circuit said second conducting plate having a second leg extending out of said bottom shell said second leg being adapted to be connected to said circuit, and said second conducting plate having a raised contact for contacting the raised contact on said extension to form a closed circuit during a downward stroke of said key cap.

2. A key switch according to claim 1 further comprising a plurality of ribs formed around the periphery of said first conducting plate for positioning said first conducting plate in one of said retaining grooves in said upper shell.

* * * * *